US006424085B1

(12) United States Patent
Jansen et al.

(10) Patent No.: US 6,424,085 B1
(45) Date of Patent: Jul. 23, 2002

(54) CATHODE RAY TUBE HAVING A DEFLECTION UNIT

(75) Inventors: Martinus H. E. Jansen, Eindhoven; Lucius T. Vinkenvleugel, Drachten; Leopold C. M. Beirens, Eindhoven, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/357,269

(22) Filed: Jul. 20, 1999

(30) Foreign Application Priority Data

Jul. 21, 1998 (EP) ..... 98202446

(51) Int. Cl.[7] ..... H01J 29/70; H01J 29/76
(52) U.S. Cl. ..... 313/440; 313/442; 348/806
(58) Field of Search ..... 313/440, 442, 313/479; 348/791, 806, 807, 805; 335/210, 211, 212, 213; 179/35 R, 35 MS

(56) References Cited

U.S. PATENT DOCUMENTS 4,709,220 A * 11/1987 Sakane et al. ..... 335/214
5,204,649 A * 4/1993 Togane et al. ..... 335/210
5,734,234 A * 3/1998 Smith et al. ..... 315/370
6,031,327 A * 2/2000 Lee ..... 313/440
6,087,768 A * 7/2000 Beirens ..... 313/442

FOREIGN PATENT DOCUMENTS

JP 62-181585 A * 8/1987 ..... H04N/9/31

* cited by examiner

*Primary Examiner*—Nimeshkumar D. Patel
*Assistant Examiner*—Karabi Guharay
(74) *Attorney, Agent, or Firm*—Robert J. Kraus

(57) ABSTRACT

A deflection unit of a cathode ray tube is provided with a cooling fan. The fan includes means for reducing the disturbing effect of the electric field generated by the fan on the deflection of the electrons, or the fan is arranged in such a manner that the disturbing effect is small.

7 Claims, 6 Drawing Sheets

CATHODE RAY TUBE HAVING A DEFLECTION UNIT

BACKGROUND OF THE INVENTION

The invention relates to a cathode ray tube comprising an electron gun for generating at least one electron beam, a display screen, and a deflection unit for deflecting the electron beam(s) across the display screen, the deflection unit including line and frame coils for deflecting the electron beam(s) in two mutually perpendicular directions, a coil holder and a yoke ring which surrounds at least one of the coils. The invention also relates to a deflection unit.

SUMMARY OF THE INVENTION

It is an object of the invention to provide a cathode ray tube of the type mentioned in the opening paragraph in which one or more of the above-mentioned problems are reduced. To this end, the invention provides a cathode ray tube and a deflection unit as defined by the independent claims. Advantageous embodiments are defined by the dependent claims.

In operation, the fan blows air past the deflection unit, thereby cooling said deflection unit. The inventors have recognized that, in operation, the fan generates an electromagnetic field which may have a disturbing effect on the deflection field, as a result of which the image quality is adversely affected.

In order to preclude, or reduce, these adverse effects, a measure is taken in the cathode ray tube in accordance with the invention, or the deflection unit is provided with means to counteract the disturbing effect of the electromagnetic field generated by the fan on the deflection.

In an embodiment, the measure includes the magnetic field of the fan, close to the fan, being directed so as to be approximately parallel to the electron beams. This results in a small disturbing effect.

In an embodiment, the measure includes the yoke ring being arranged between the fan and the coils. The yoke ring shields the coils from the disturbing field of the fan.

In an embodiment, the measure comprises an air-permeable magnetically conducting filter arranged between the fan and the coils. By virtue thereof, the stray field of the fan is substantially reduced.

In an embodiment, the measure comprises means for generating an electromagnetic field which is in opposition to the field of the fan.

Said means may be an auxiliary coil arranged close to, or preferably around, the fan, which auxiliary coil is energized in operation in order to generate an electromagnetic field which is in phase opposition relative to the field generated by the fan. In a further embodiment, the deflection unit may be provided with two fans which are arranged close to each other and which generate electromagnetic fields which are in opposition.

The measures may be roughly divided into passive measures or means and active measures or means. Active measures or means are used to generate an opposite electromagnetic field to compensate for the field generated by the fan. Passive means reduce the field, for example by the position of the fan behind the yoke ring or the type of field generated (a lateral field) or by shielding.

The coil constitutes a means for generating a compensating field which is in opposition to the interference field generated by the fan. The deflection unit may also be provided with two fans generating opposite interference fields, so that the sum of both fields is substantially zero. This can be achieved, for example, by arranging two fans in diametrically opposite positions (for example on the left and on the right), and driving these fans in such a way that the currents are in phase opposition. As a result, the sum of the two fields between the two fans is zero. The fans may alternatively be positioned one above the other, or both on one side of the deflection unit.

These and other aspects of the invention will be apparent from and elucidated with reference to the embodiments described hereinafter.

DESCRIPTION OF THE PREFERRED EMBODIMENTS

Figure 1:
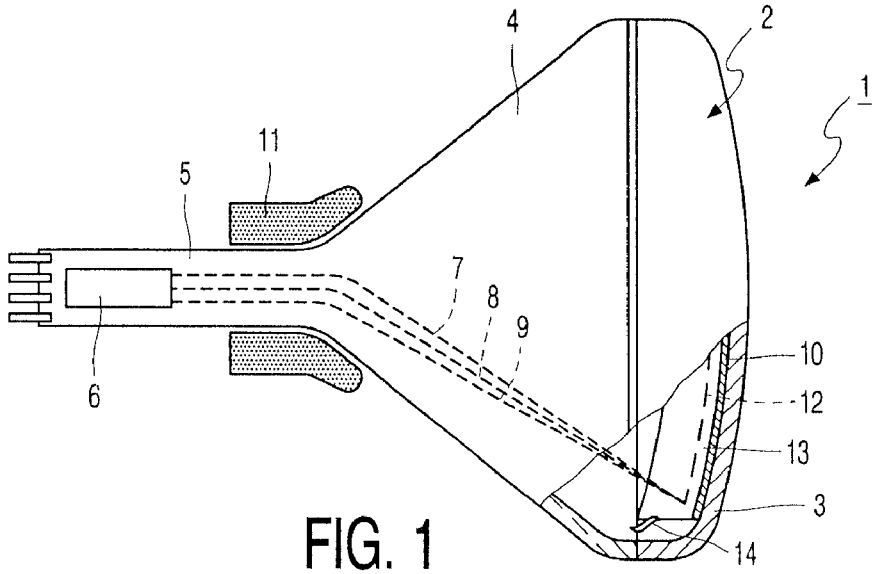
FIG. 1 PRIOR ART
FIG. 1 shows a cathode ray tube.

The Figures are diagrammatic and not drawn to scale and, in general, like reference numerals refer to like parts.

FIG. 1 is a sectional view of a cathode ray tube 1, in this case a color cathode ray tube, which comprises an evacuated envelope 2 with a substantially rectangular display window 3, an enveloping portion or cone portion 4 and a neck 5. The neck 5 accommodates an electrode system 6 for generating, in this example three, electron beams 7, 8 and 9. In this example, the electron beams are generated in one plane (here the plane of the drawing) and are directed to an electroluminescent display screen 10 provided on the inner surface of the display window, which electroluminescent display screen comprises a phosphor pattern consisting of a large number of phosphor elements luminescing in red, blue and green. The phosphor elements may be, for example, dot-shaped or strip-shaped. On their way to the display screen 10, the electron beams 7, 8 or 9 are deflected by means of a deflection unit 11 across the display screen 10 and pass through a color selection electrode 12 which is arranged in front of the display screen 10 and which includes a thin plate with apertures 13. The three electron beams 7, 8 and 9 pass through the apertures 13 of the color selection electrode 12 at a small angle and, consequently, each electron beam impinges only on phosphor elements of one color. The color selection electrode 12 is suspended in front of the display screen by means of suspension elements 14.

Figure 2:
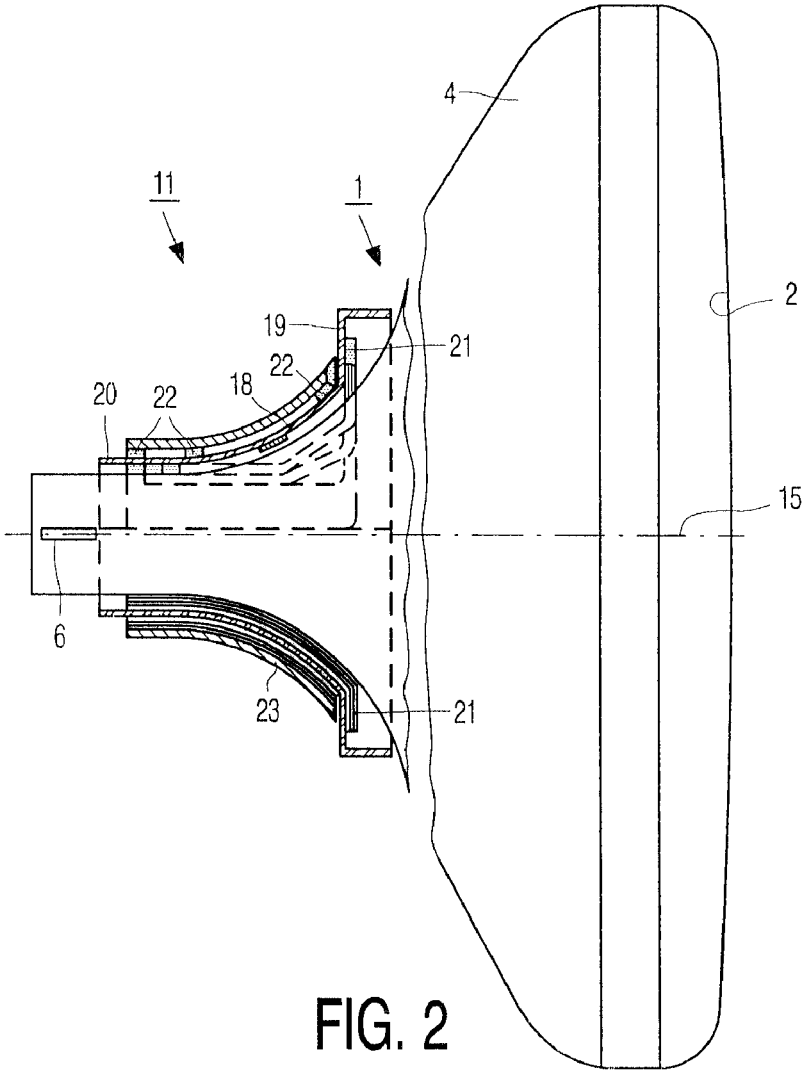
FIG. 2 shows a detail of a cathode ray tube in accordance with the invention.

FIG. 2 is a diagrammatic, sectional view of a known design of a cathode ray tube having a deflection unit 11. The tube axis 15 is indicated in the figure. The tube axis 15 substantially coincides with a symmetry axis of the deflection unit 11. The deflection unit comprises a coil holder 18 of an electrically insulating material (often a synthetic resin) having a front end portion 19 and a rear end portion 20. A line deflection coil system 21 for generating a (line) deflection field for deflecting electron beams generated by the electron gun in the horizontal (line) direction is situated on the inside, between these end portions, and a frame deflection coil system 22 for generating a (frame) deflection field in the vertical direction is situated on the outside of the coil holder. Each coil system generally includes two sub-coils. The deflection unit further includes a yoke ring 23.

Both coil systems are secured to the coil holder. In operation, the temperature of the cathode ray tube, particularly the temperature of the deflection unit, increases. The coil systems are secured (for example by means of an adhesive or hooks) to the coil holder. When the temperature rises, differences in temperature and in thermal expansion between the coil systems, coil holder and yoke ring cause changes in the relative positions of these elements. These changes have a negative influence on the quality of the image displayed.

Figure 3:
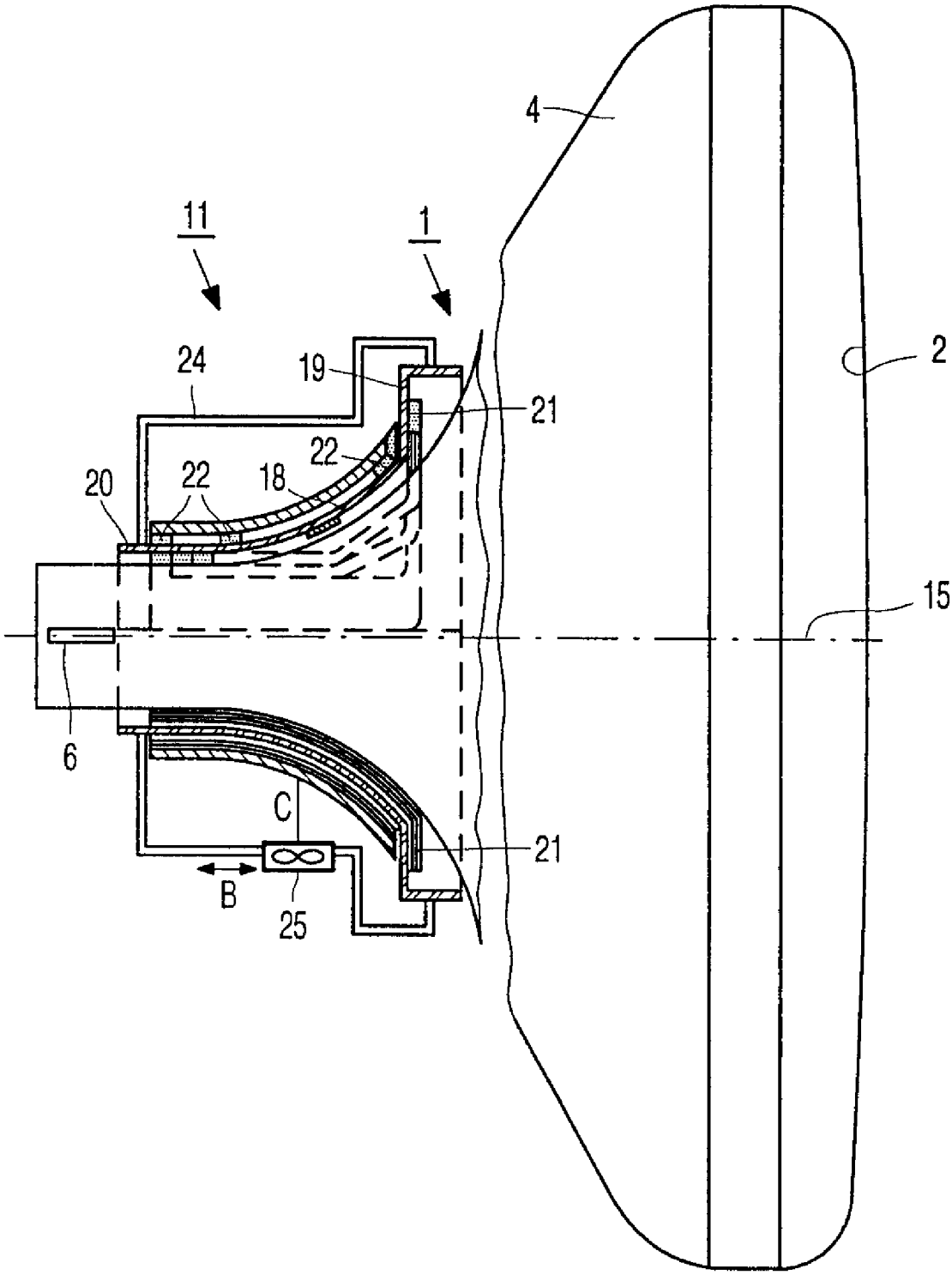
FIGS. 3, 4, 5 and 6 show in detail further embodiments of a cathode ray tube in accordance with the invention.

FIG. 3 schematically shows a cathode ray tube in accordance with the invention. The deflection unit 11 is provided with a fan 25 in a housing 24, by means of which fan air can be blown past the deflection unit. In operation, a fan generates an electromagnetic stray field. These effects may be very disturbing. This has been realized by the inventors. Although the interference fields are small, the disturbing effect often is substantial if the distance between the fan and the coils is less than 10 cm. In general, the electromagnetic field has a main direction in which the intensity is highest. In directions transverse to the main direction, the field intensity is much (approximately one order of magnitude) lower. If the main direction of the magnetic field of the fan (indicated by arrows B in FIG. 3) is parallel to the tube axis, then the disturbing effect of the magnetic field is small. If the main direction of the magnetic field is transverse to the tube axis 15, then the disturbing effect is much greater. For this reason, preferably, the main direction of the magnetic field (or "the magnetic field" for short) of the fan is parallel to the tube axis 15. Preferably, the fan has the property that the magnetic field extends transversely to the rotary shaft C of the fan and that the rotary shaft extends transversely to the tube axis 15. In this case, the fan blows the cooling air directly towards the deflection unit, causing the disturbing effect of the electromagnetic field of the fan to be small.

The yoke ring is preferably situated between the fan and the tube axis. The yoke ring has a shielding effect, that is the field of the fan is weakened by the yoke ring at the location of the electron beam 7, 8, 9. Electromagnetic fields transverse to the tube axis (and hence transverse to the yoke ring) are weakened to a smaller degree than electromagnetic fields extending parallel to the tube axis. Table 1 gives an average value of frame errors in a 17" computer monitor for fans which generate an axial electromagnetic field, i.e. a field extending substantially parallel to the rotary shaft of the fan and hence, in the arrangement shown in FIG. 3, in a direction transverse to the tube axis (the C-direction), and for fans which generate a lateral electromagnetic field, i.e. a field extending substantially transversely to the rotary shaft of the fan and hence in the B-direction, parallel to the tube axis. The bottom row shows the maximally accepted frame error for this type, i.e. a greater error will lead to rejection of the monitor.

| fan type | maximum frame error |
|---|---|
| axial field | 0.2–0.4 mm |
| lateral field | 0.01–0.04 mm |
| specification | 0.1 mm |

It is clear that a fan with a field oriented in the C-direction has an unacceptably great disturbing effect, while the fans having a field oriented in the B-direction only have a small disturbing effect. The distance between the fan and the tube axis is approximately 5 cm. The disturbing effects of a fan having a field oriented in the B-direction (parallel to the tube axis) are approximately one order of magnitude smaller than the disturbing effects of a fan having a field oriented transversely to the tube axis (C-direction). An example of a fan having an "axial field" is Papst 412; examples of fans having "lateral fields" are Innovative BP401012 and NIDECD04X-12TL. Viewed from the source of the electromagnetic field (in this case the fan), electromagnetic fields generally demonstrate a decrease by the square or third power of the distance between a measuring point and the source. A source generating an interference field at a location should consequently be removed two to three times as far from the location to reduce the interference by one order of magnitude. Fans having a field in the B-direction may be arranged on the deflection unit, for example at a distance below 10 cm, preferably 4–7 cm, from the tube axis, while a fan having a field in the C-direction must be removed two to three times this distance from the tube axis to obtain a similar disturbing effect. However, the larger the distance between the fan and the deflection unit, the more inefficient the cooling effect and the larger the deflection unit is.

The dimensions of a fan generally range from approximately 10×10 mm to 40×40 mm.

Figure 4:
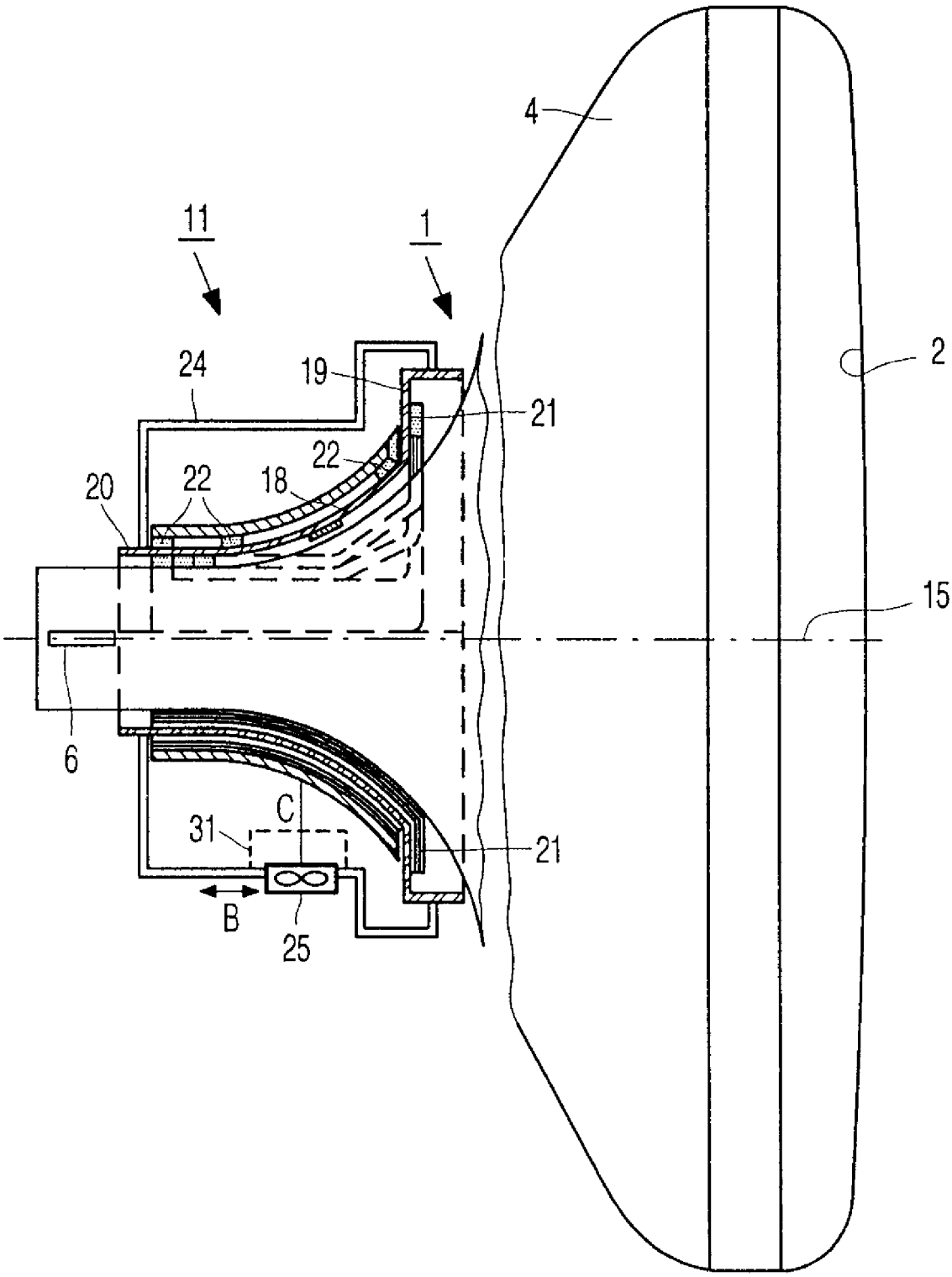

FIG. 4 shows an embodiment of the cathode ray tube in accordance with the invention. In this embodiment, an air-permeable, electroconductive filter 31 is arranged between the fan 25 and the coils. This filter serves as a shield between the fan and the coils. A filter has the disadvantage that it adversely affects the flow of air, because it constitutes a resistance.

Figure 5:
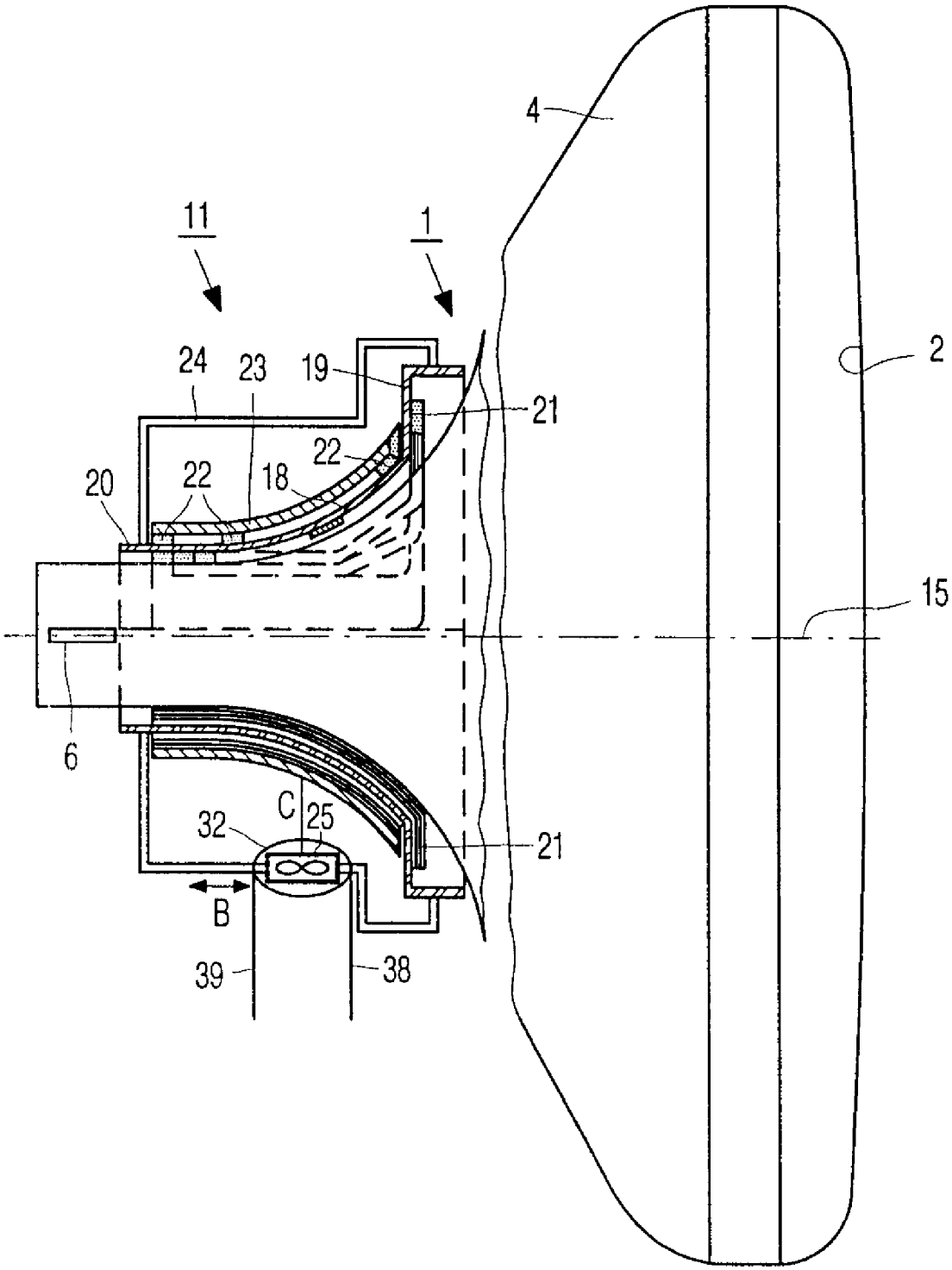

FIG. 5 shows an embodiment of the cathode ray tube in accordance with the invention. In this embodiment, the deflection unit is provided with a coil 32 with connecting wires 38 and 39. In operation, by sending an electric current through the coil 32, the coil 32 generates an electric field which is synchronous with the field generated by the fan, and of approximately the same field intensity, yet oppositely directed. As a result, the fields generated by the fan and the coil 32 substantially neutralize each other. Thus, disturbing effects of the fan on the deflection of the electron beams are reduced substantially.

Figure 6:
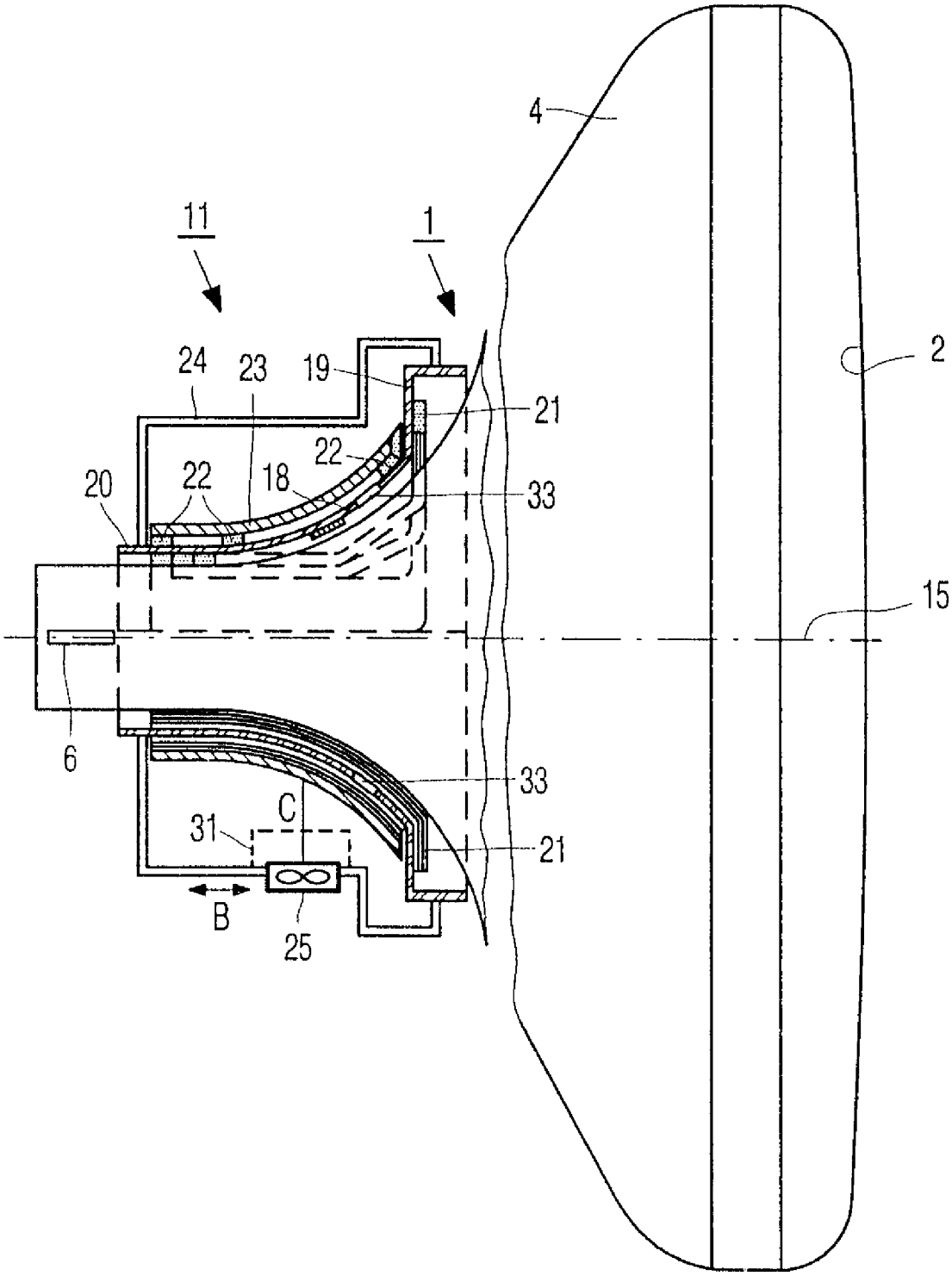
Figure 7:
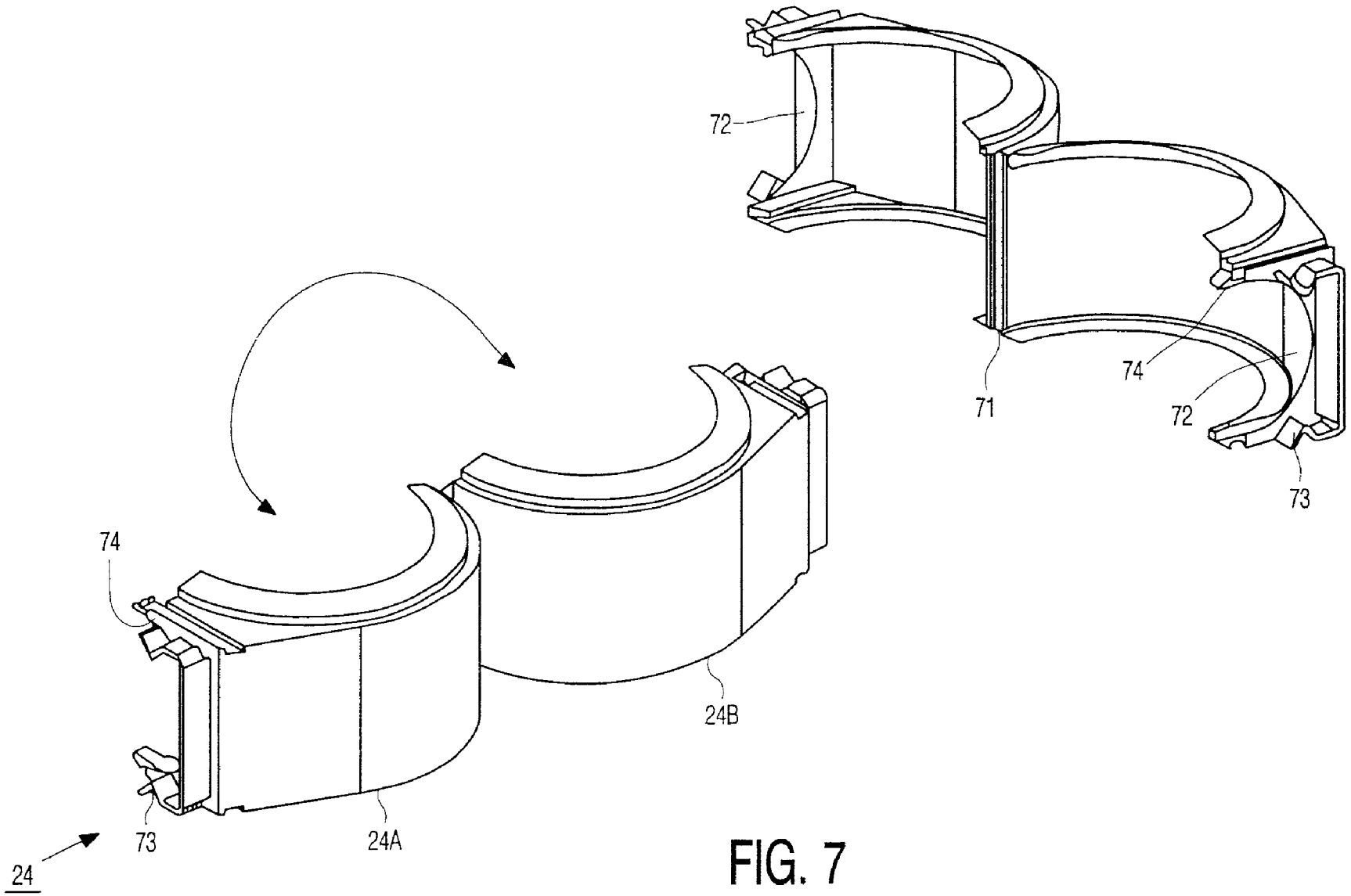
FIG. 7 shows a housing for a fan.

FIGS. 3, 4 and 5 show that the fan 25 is arranged in a housing 24. The housing 24 constitutes a jacket around the rest of the deflection unit. FIG. 6 shows a preferred embodiment. In this embodiment, the coil holder is provided with apertures 33 for allowing passage of air. The air blown by the fan cools the coil system 22 and also flows through the apertures towards the coil system 21. The air then flows between the evacuated envelope 2 and the coil system 21. This way of cooling is very efficient because both coil systems are cooled and the air is forced closely past the coil system 21. The electromagnetic field generated by the fan is a function of the necessary power. Efficient cooling, as in the embodiment shown in FIG. 6, leads to a reduction of the necessary power. FIG. 7 shows two views of a housing 24. The housing comprises two parts 24A and 24B, which are interconnected by means of a hinged part 71. The housing 24 is arranged around the deflection unit and closed. Both parts 24A and 24B have a recess 72, which recesses jointly constitute an aperture for a fan. The parts 24A and 24B further have hooks 74 which are hooked together when the housing is in the closed state, and resilient elements 73 for fixing the fan. The housing shown in FIG. 6, which comprises two portions joined by a hinged part and recesses for the fan is simple and robust.

The invention can be briefly summarized as follows:

A deflection unit for, or of, a cathode ray tube is provided with a fan. The effects of the disturbing electromagnetic fields generated, in operation, by the fan are reduced by taking measures. The measures may include a number of aspects which may be present separately and/or in combination.

A first aspect consists in that the field generated by the fan, in operation, extends parallel to the tube axis, i.e. the main direction of the field (N-S direction) is parallel to the tube axis.

A second aspect consists in that the coils are shielded from the field generated by the fan, for example by the position of the fan relative to the yoke ring and the coils (the yoke ring is situated between the fan and the coils), or by shielding (an air-permeable, electroconductive air filter between the coils and the fan), or by compensating measures (a compensating coil is used to generate a field in the opposite direction).

A third aspect consists in that the fan is accommodated in a housing, which housing encloses the rest of the deflection unit, the coil holder having apertures for allowing air to reach the coils situated inside the coil holder. As a result, the cooling efficiency is increased, so that the fan needs less power, resulting in a reduction of the interference fields.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The words "comprising" or "includes" do not exclude the presence of other elements or steps than those listed in a claim. The word "a" or "an" preceding an element does not exclude the presence of a plurality of such elements.

What is claimed is:

1. A cathode ray tube comprising an electron gun for generating an electron beam, a display screen, and a deflection unit for deflecting the electron beam across the display screen, the deflection unit including line and frame coils for deflecting the electron beam in two mutually perpendicular directions, a coil holder and a yoke ring which surrounds at least one of the coils, characterized in that the deflection unit is provided with a fan for blowing air to cool said defection unit, said fan having an electric motor which, in operation, produces an electromagnetic field extending externally of said motor, said motor being oriented relative to the unit to reduce a negative influence of said field on the deflection of the electron beam.

2. A cathode ray tube as claimed in claim 1, characterized in that the fan motor is oriented such that a main direction of the field is approximately parallel to the electron beam.

3. A cathode ray tube as claimed in claim 1, characterized in that the yoke ring is disposed between the fan and the coils.

4. A cathode ray tube as claimed in claim 1, characterized in that a magnetically conducting air filter is disposed between the fan and the coils.

5. A cathode ray tube as claimed in claim 1 including a coil for generating an electromagnetic field which is in opposition to the electromagnetic field extending externally of the fan motor.

6. A cathode ray tube as claimed in claim 1, characterized in that the fan is arranged in a housing, which connects to the deflection unit, and that the coil holder has apertures for allowing passage of air.

7. A deflection unit for deflecting an electron beam produced within a cathode ray tube, characterized in that the deflection unit is provided with a fan for blowing air to cool said deflection unit, said fan having an electric motor which, in operation, produces an electromagnetic field extending externally of said motor, said motor being oriented relative to the unit to reduce a negative influence of said field on the deflection of the electron beam.

* * * * *